US005147075A

United States Patent [19]

Regan

[11] Patent Number: 5,147,075

[45] Date of Patent: Sep. 15, 1992

[54] ACTUATING MECHANISM FOR PRESSURIZED FLUID CONTAINERS AND NOZZLE ASSEMBLY

[75] Inventor: Richard B. Regan, New York, N.Y.

[73] Assignee: Falcon Safety Products Incorporated, Somerville, N.J.

[21] Appl. No.: 700,113

[22] Filed: May 8, 1991

Related U.S. Application Data

[63] Continuation of Ser. No. 252,750, Oct. 3, 1988, abandoned.

[51] Int. Cl.[5] ..... B65D 83/00

[52] U.S. Cl. ..... 222/402.15; 222/566; 285/168

[58] Field of Search ..... 222/402.13, 402.15, 222/394, 321, 473, 472, 566, 527, 74; 285/163, 164, 168

[56] References Cited

U.S. PATENT DOCUMENTS

| | | | |
|---|---|---|---|
| 984,557 | 2/1911 | Garter | 285/164 |
| 1,285,291 | 11/1918 | McLaughlin | 285/168 |
| 1,338,242 | 4/1920 | Moise . | |
| 2,855,225 | 10/1958 | Golden | 285/168 |
| 2,887,329 | 5/1959 | Blakely | 285/168 |
| 3,189,232 | 6/1965 | Joffe | 222/394 |
| 3,478,935 | 11/1969 | Brooks | 222/321 |
| 3,580,432 | 5/1971 | Brooks | 222/402.13 |
| 3,624,219 | 11/1971 | Perlitsh | 222/394 |
| 3,987,942 | 10/1976 | Morane et al. | 222/402.15 |
| 4,401,240 | 8/1983 | Brack | 222/323 |
| 4,432,474 | 2/1984 | Hutchinson et al. | 222/402.15 |
| 4,438,479 | 3/1984 | Schwartz et al. | 361/213 |
| 4,456,153 | 6/1984 | Mashberg | 222/473 |

FOREIGN PATENT DOCUMENTS

| | | | |
|---|---|---|---|
| 6452-66 | 12/1967 | Australia . | |
| 77538-75 | 7/1976 | Australia . | |
| 73560-81 | 2/1982 | Australia . | |
| 14202-88 | 8/1988 | Australia . | |
| 0302994 | 2/1989 | European Pat. Off. . | |
| 366952 | 1/1923 | Fed. Rep. of Germany . | |
| 439285 | 7/1949 | Italy | 285/164 |

OTHER PUBLICATIONS

SYNC, The Synchronics Catalog, Hanover, Pa. Fall 1988, p. 12.

*Primary Examiner*—Robert P. Olszewski
*Assistant Examiner*—Kenneth Noland

[57] ABSTRACT

This invention comprises an activating device for releasing fluid from a pressurized container and a nozzle device for directing the fluid therethrough to a desired location. The activating device comprises a lever which transmits an applied force to a flange which exerts a downward force to the top of a spout in a valve assembly used to release the contents of a pressurized container. When force is applied to the lever, the flange rotates about a fulcrum located at a higher elevation than the point at which the flange contacts the spout. This results in a trigger mechanism with a high degree of leverage. The nozzle device contains a first joint for rotating a first barrel of the nozzle 360° around a first axis defined by the first barrel of the nozzle and a second joint for rotating a second barrel of the nozzle at least 180° around an axis perpendicular to the first axis. This combination results in a nozzle that can point in virtually any direction without the necessity of moving the source of the fluid directed through the nozzle.

14 Claims, 3 Drawing Sheets

ACTUATING MECHANISM FOR PRESSURIZED FLUID CONTAINERS AND NOZZLE ASSEMBLY

This is a continuation of copending application Ser. No. 07/252,750 filed on Oct. 3, 1988 now abandoned.

BACKGROUND OF THE INVENTION

This invention relates to an improved actuating mechanism for releasing gas from a container of pressurized liquified gas. This invention has particular application to a dust blowing device and an improved nozzle for directing the flow of fluid therethrough.

Presently, dust blowing devices generally consist of a pressurized gas source, a valve and a nozzle for directing the gas flow. The pressurized gas is used to blow dust or other particles from the surface to be cleaned e.g. floppy disks for computers; lenses for microscopes, cameras and other optical instruments, assembled microchips, consumer electronic devices and other small or hard-to-reach places.

These devices typically use liquified chloroflourocarbon, e.g. Freon (Freon is a trade name for a particular chloroflourocarbon manufactured by DuPont), stored in a pressurized container. When this liquified Freon is released from the container, it changes to gas and exits the container under pressure. A jet of Freon gas is thus used to blow dust from the surface to be cleaned. However, in order to ensure that only Freon gas is released from the container, the container must be maintained in a substantially upright position. If the can is inverted, liquified Freon may escape from the container. For the typical consumer, it is desirable to avoid this. Liquified Freon is extremely cold and can cause frostbite if it contacts the user's hand. Also, allowing liquified Freon to escape from the container results in wasted Freon.

Unfortunately, it is difficult to maintain the dust blowing device in a substantially upright position when directing the gas on hard-to-reach surfaces such as in consumer electronic devices. Another problem with devices that use Freon as the gas source is that chlorofluorocarbons are believed to destroy the earth's protective layer of ozone. As a result, many industries are seeking alternatives to chlorofluorocarbons or are reducing the amounts of chlorofluorocarbons needed for their products.

Other types of liquified gas that are environmentally safe may be used in dust blowing devices. These gases, such as Freon-22, are believed to degrade at lower elevations in the earth's atmosphere. Therefore ineffective concentrations of ozone depleting compounds would reach the earth's ozone located at higher elevations in the earth's atmosphere. However, to remain liquid, these gases must be maintained at pressures higher than those used in current dust blowing devices.

It is therefore an object of this invention to provide a dust blowing device that will direct fluid onto hard-to-reach places while remaining substantially upright.

It is another object of this invention to provide a nozzle for directing the flow of fluid therethrough that can be adjusted to point in virtually any direction without moving the source of fluid.

It is yet another object of the invention to provide an actuating mechanism suitably adapted for use in a dust blowing device that will direct fluid onto hard-to-reach places.

It is still another object of this invention to provide a nozzle and actuating mechanism that directs the flow of fluid from a container of fluid subjected to high pressures.

Other objects and advantages will become apparent hereinafter.

SUMMARY OF THE INVENTION

This invention comprises a means for releasing fluid from a pressurized container and a nozzle means for directing fluid therethrough to a desired location. Although this invention is described in terms of dust blowing devices that use liquified gas such as Freon as the source of fluid, it is to be understood that this invention has applicability to devices that direct the flow of other types of fluids. For example, most liquids and gases including butane and ammonia, can be used with the nozzle assembly of this invention.

A standard valve assembly is used to release gas from a pressurized container. The valve assembly includes a hollow spout through which fluid in the container is emitted and a gasket sealing the container's orifice. Upon application of a downward pressure on the spout, the gasket, which is held by spring tension to cover the container's orifice, is moved away from the container's orifice. This allows the emission of fluid from the container through the spout.

A trigger mechanism is used for actuating the valve assembly to release fluid from the container. The trigger mechanism comprises a lever which is pulled by the user. The lever rotates about a fulcrum transferring the force applied to the lever to the top of the spout. The fulcrum for the trigger mechanism is located above the top of the spout resulting in a trigger mechanism with a high degree of leverage.

The nozzle assembly contains a first joint means for rotating the barrel of the nozzle 360° around a first axis defined by the barrel of the nozzle and a second joint means for rotating the barrel of the nozzle at least 180° around an axis perpendicular to the first axis. Alternatively the first joint means rotates the barrel of the nozzle at least 180° around an axis perpendicular to the first axis while the second joint means rotates the barrel of the nozzle 360° around the first axis.

DETAILED DESCRIPTION OF THE INVENTION

Figure 1:
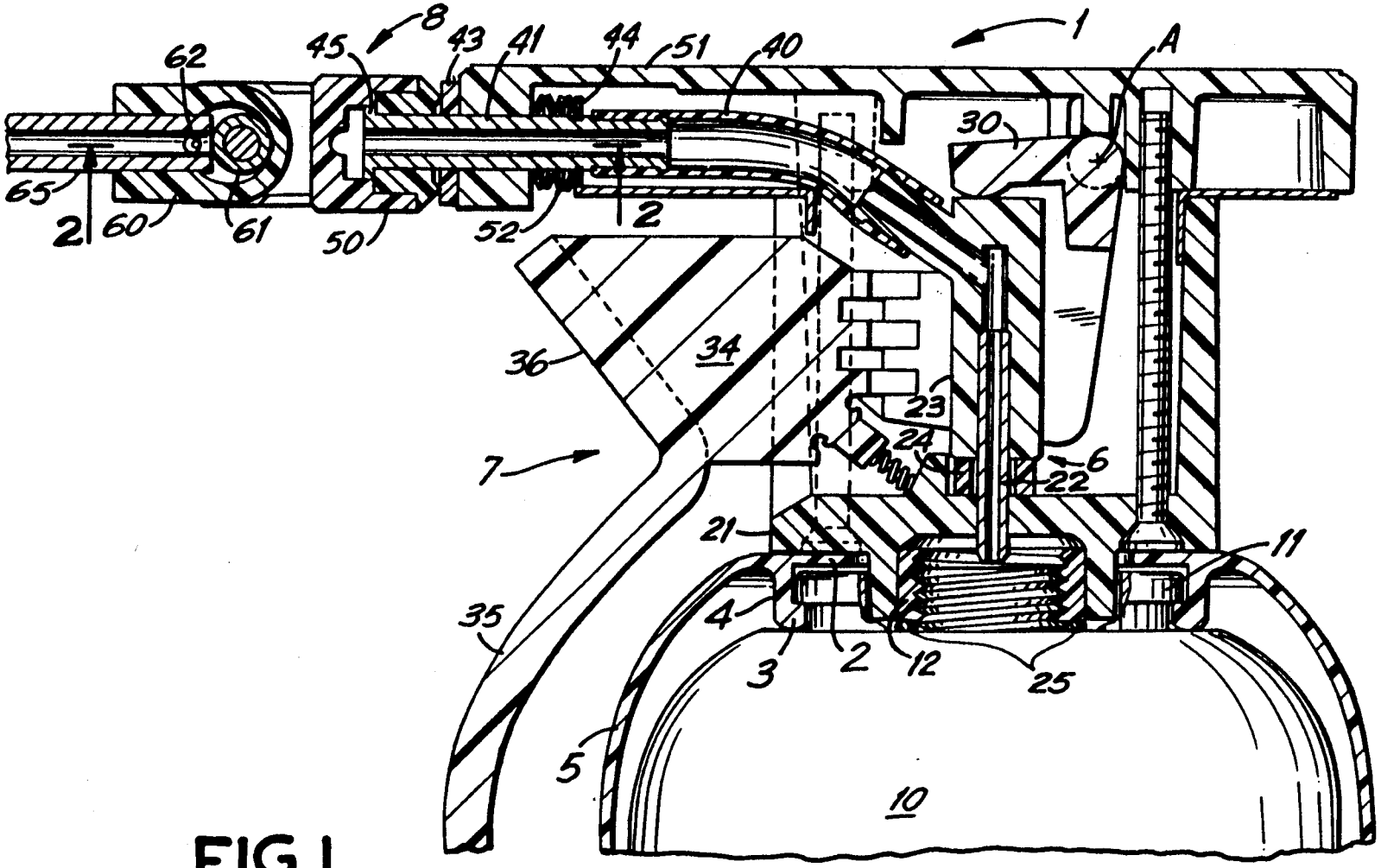
FIG. 1 is an elevational view in longitudinal section of one embodiment of this invention.

Referring initially to FIG. 1, a pressurized fluid container 10 is fitted with a cap 5, and actuating mechanism 1. Actuating mechanism 1 comprises the valve assembly 6, trigger mechanism 7 and nozzle assembly 8 of the invention.

Cap 5 snaps onto the container rim 11. Collar 4 containing shoulder 2 and lip 3 ensures a tight fit between cap 5 and container 10 and ensures that the actuating mechanism 1 properly fits onto container 10. Valve assembly 6 may be fixedly connected to container 10 or may be fixedly connected to actuating mechanism 1 and placed in communication with the contents of container 10 when actuating mechanism 1 is connected to container 10. Valve assembly 6 may also be a separate assembly or certain portions of it may be fixedly connected to container 10 with certain other portions fixedly connected to actuating mechanism 1.

Valve assembly 6 releases the contents of container 10 via conventional means. An orifice in the top of container 10 (not shown) is sealed by a gasket (not shown) held against the orifice by a spring means (not shown) inside container 10. When spout 22 is pressed downwardly through the orifice and against the gasket, the contents of container 10, which are under pressure, rush through the orifice and spout 22. When the downward force on spout 22 is released, the gasket is urged against the orifice by the spring means closing the orifice and preventing the further emission of the contents of container 10 into the atmosphere.

When the unit is not in use, spout 22 is held outside of the orifice of container 10. Spout 22 is placed in fluid communication with the contents of container 10 via actuating mechanism 1. In this way, valve assembly 6 can be used in conjunction with containers of fluid held under very high pressures with spout 22 providing for the controlled release of such fluids.

Actuating mechanism 1 is attached to container 10 by threaded member 12. Threaded member 12 is hollow to allow spout 22 to be placed in fluid communication with the contents of container 10. Frame 21 is fixedly connected to threaded member 12. Preferably frame 21 is connected to threaded member 12 by ultrasonic sealing. This type of connection is strong and is not subject to corrosion by fluids such as liquified Freon that may be stored in container 10. Frame 21 and threaded member 12 are preferably formed from a plastic corrosively resistant to the contents of container 10, such as Teflon, nylon or an acetal resin, e.g. Delrin. (Delrin and Teflon are trade names for products manufactured by DuPont.) Alternatively, frame 21 and threaded member 12 may be formed from metal such as aluminum, steel or brass. When actuating mechanism 1 is connected to container 10 via threaded member 12, frame 21 rests on cap 5. Preferably a gasket 25 is placed between threaded member 12 and container 10 to prevent leakage of fluid between valve assembly 6 and container 10 when fluid is released from container 10. Gasket 25 allows spout 22 to release fluid stored under higher pressure in container 10 without leakage between container 10 and spout 22.

Spout 22 fits through an opening in the bottom of frame 21. In this way, when a downward pressure is applied to the top of spout 22, spout 22 moves through threaded member 12 and is placed into fluid communication with the contents of container 10. This provides the passage through which fluid travels from container 10 and into the atmosphere. Spout 22 fits snugly inside sleeve 23. Preferably sleeve 23 and spout 22 are formed from a corrosively resistant plastic but they can be formed from metal as described with respect to frame 21 and threaded member 12. Also, sleeve 23 and spout 22 are preferably connected by ultrasonic sealing.

Sleeve 23 is substantially hollow and forms a passage for the fluid issuing from container 10 to travel to nozzle assembly 8. When a downward force is applied to sleeve 23, this force is transmitted to spout 22. As a result, spout 22 is placed in fluid communication with the contents of container 10 by moving a gasket away from an orifice in container 10.

Spring means 24 may be located between frame 21 and sleeve 23. Spring means 24 forces sleeve 23 away from frame 21. As a result, spout 22 is pulled away from fluid communication with the contents of container 10 once any downward force is removed from sleeve 23. Preferably spring means 24 is a resilient gasket which prevents leakage of fluid between frame 21 and sleeve 23. This gasket also acts to move sleeve 23 away from frame 21 once a downward force is removed from sleeve 23.

Trigger mechanism 7 is a lever having handle 35 at one end and flange 30 at the other end. Flange 30 rotates around fulcrum A to transmit a downward force to the top of sleeve 23. Handle 35 is configured so it is comfortable to the grasp. As shown in FIG. 1, handle 35 may have a finger rest 36 which allows the unit to be carried without activating trigger mechanism 7. In this embodiment, handle 35 is below the point where flange 30 contacts sleeve 23. The body 34 of trigger mechanism 7 may include sleeve 23 as an integral part thereof. Preferably it is a separate element distinct from sleeve 23 and formed to pass around sleeve 23 and spout 22. Flange 30 abuts the cap or shoulder of sleeve 23. As is apparent from FIG. 1, a force directed to container 10 and exerted along handle 35 is transmitted about fulcrum A to flange 30. Flange 30 thereby rotates in a counterclockwise direction and exerts a downward force on the cap or shoulder of sleeve 23 causing spout 22 to be pressed downwardly and placed in fluid communication with the contents of container 10.

Fulcrum A is positioned above the cap or shoulder of sleeve 23 and the distance from fulcrum A to the point on flange 30 that contacts the cap or shoulder of sleeve 23 is shorter than the distance between fulcrum A and the location on handle 35 where the force is applied by the user. This combination results in a trigger mechanism having a high degree of leverage. Flange 30 moves a shorter distance than handle 35 which results in a downward force exerted on sleeve 23 that has a higher magnitude than the force exerted on handle 35 by a user.

A force exerted along finger rest 36 is likewise transmitted about fulcrum A. However, in this case, flange 30 rotates in a clockwise direction around fulcrum A. Flange 30 therefore does not exert a downward force on sleeve 23. As a result, fluid will not be accidentally released from container 10 when a user carries container 10 by grasping the unit by finger rest 36.

Spring means 37 may be placed between trigger mechanism 7 and frame 21. After handle 35 is released by a user, spring means 37 causes handle 35 to move away from container 10 to its rest position resulting in a clockwise rotation of flange 30. This allows spout 22 to move out of fluid communication with the contents of container 10.

Flexible tubing 40 connects sleeve 23 with first barrel 41. Tube 40 is made from a corrosively resistant plastic as described in connection with frame 21 and threaded member 12, preferably Teflon. Tube 40 may be connected to first barrel 41 and sleeve 23 by any known connection means such as by using clamps or solvents or by using ultrasonic sealing. Tube 40 should be flexible to allow for the increased distance between sleeve 23 and first barrel 41 when sleeve 23 moves downward.

Figure 2:
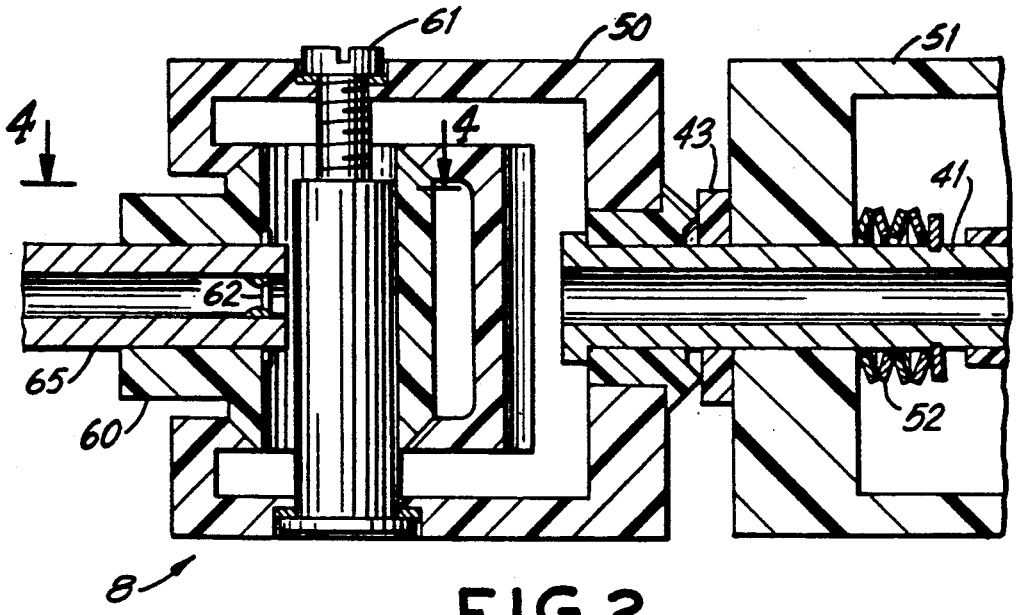
FIG. 2 is an enlarged section taken on the line 2—2 of FIG. 1 of the means for orienting the nozzle assembly.

Referring now to FIG. 2, first barrel 41 fits through an opening in shroud 51 and an opening in yoke 50. A washer 43 is placed around first barrel 41 between yoke 50 and shroud 51. Preferably washer 43 is a Teflon washer to allow yoke 50 to rotate freely around first barrel 41 with respect to shroud 51. Spring means 52 such as one or more spring washers, e.g. Belleville washers, are disposed around first barrel 41 between shroud 51 and first shoulder or retaining ring 44. When compressed, spring means 52 exerts a force on first barrel 41 pushing it toward sleeve 23. By using second shoulder 45 at the end of first barrel 41, yoke 50 and shroud 51 are pulled together. This arrangement ensures a tight seal between first barrel 41 and yoke 50 preventing any fluid from escaping except through second barrel 65. This arrangement allows yoke 50 to be freely rotatable 360° around the axis of first barrel 41. Tension screws or other locking means (not shown) can be placed through yoke 50 and shroud 51 to fix the position of yoke 50 with respect to shroud 51 once the desired rotation is achieved.

Member 60 is fitted between the prongs of yoke 50. To ensure a tight seal between member 60 and yoke 50 the mating surfaces of member 60 and yoke 50 are angled and a tension screw 61 is used to press the prongs of yoke 50 together. Tension screw 61 may be tightened to lock the position of member 60 with respect to yoke 50 once the desired rotation of member 60 is achieved. Member 60 is hollow to allow the insertion of tension screw 61 and the passage of fluid from yoke 50 therethrough to second barrel 65 which is fitted into the side of member 60. Second barrel 65 is preferably held in place in member 60 by pin means 62. However, second barrel 65 may also be connected to member 60 via ultrasonic sealing or by molding it to member 60.

Figure 4:
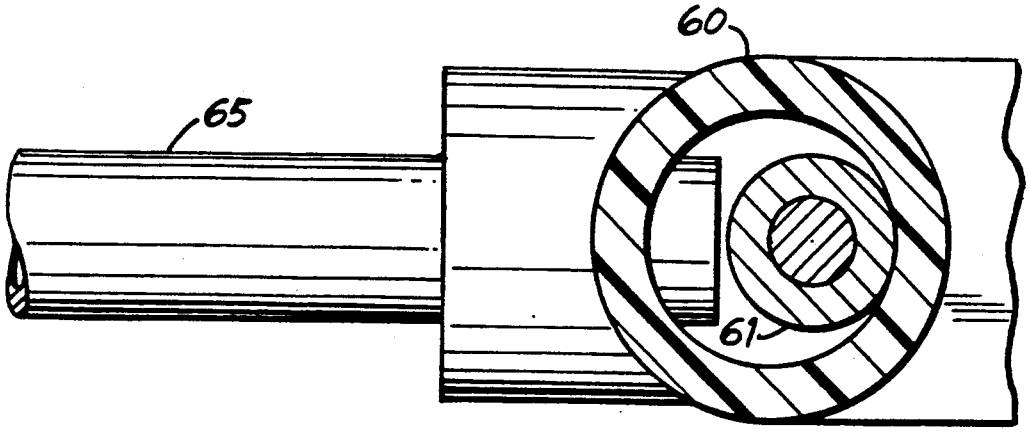
FIG. 4 is an enlarged section taken on the line 4—4 of FIG. 2 of one joint in the means for orienting the nozzle assembly.

Preferably tension screw 61 is not aligned coaxially with the opening in member 60 through which tension screw 61 is fitted. This arrangement creates a better flow path for the fluid through member 60 and into second barrel 65. See FIG. 4. Moreover, the space in yoke 50 and the space in member 60 for the passage of fluid therethrough allows more area for liquified gas flowing from container 10 to change to gas. This area also reduces the likelihood that nozzle assembly 8 will become clogged.

Member 60 rotates about an axis parallel to tension screw 61. This allows second barrel 65 to rotate at least 180° around the axis of rotation of member 60. The combination of the ability of yoke 50 to rotate 360° around the axis of first barrel 41 and the ability of member 60 to rotate at least 180° about an axis perpendicular to the axis of rotation of yoke 50 allows second barrel 65 to point in any direction in front of the end of first barrel 41 without moving container 10. Preferably yoke 50 and member 60 are formed from a corrosively resistant plastic as discussed in connection with frame 21 and threaded member 12. Preferably first barrel 41 and second barrel 65 are formed from metal as discussed in connection with frame 21 and threaded member 12.

Figure 3:
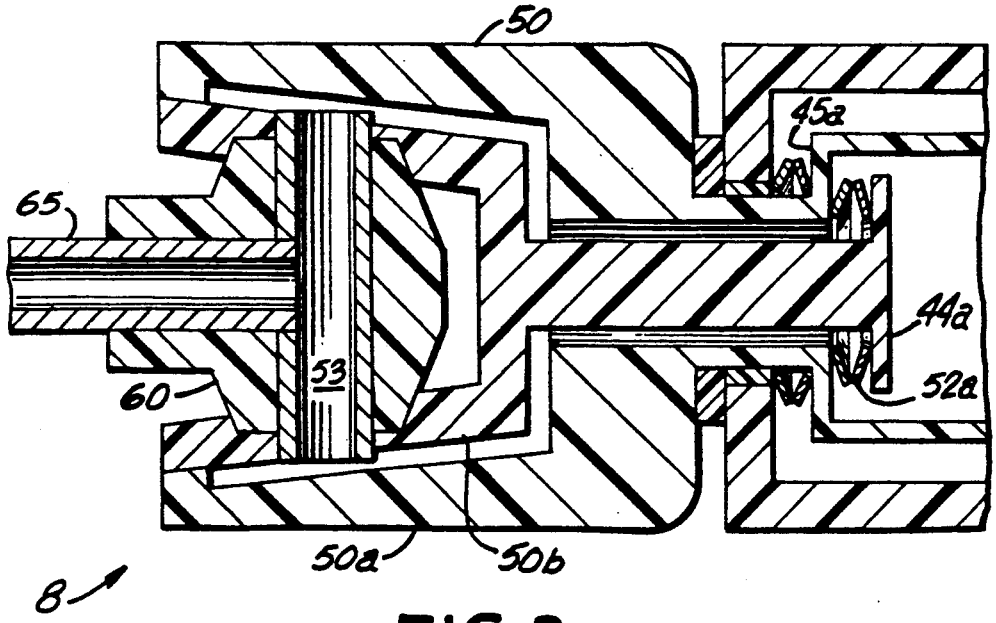
FIG. 3 is another embodiment of the means for orienting the nozzle assembly.

Referring now to FIG. 3 which is an alternative embodiment of nozzle assembly 8, yoke 50 has an outer member **50*a* and an inner member 50*b*. Inner member 50*b* is nested inside outer member 50*a* to create a passage for fluid to enter member 60. Outer member 50*a* and inner member 50*b* can be two separate pieces joined together or they can be part of a single unit. If outer member 50*a* is a separate element from inner member 50*b*, inner member 50*b* is wedged into member 50*a* via spring tension. Spring means 52*a* such as one or more spring washers, e.g. Belleville washers, are compressed and placed between first flange means 44*a* and shoulder 45*a* to create the spring tension. In another embodiment, inner member 50*b* is sealed into outer member 50*a*** via ultrasonic sealing.

Passages for fluid to travel to member 60 are disposed in both prongs of inner member **50*b*. An axle 53 may be placed through the prongs of inner member 50*b* and through member 60 to prevent leakage of fluid. Preferably a split pin axle is used to allow fluid to pass through axle 53 from the passage created by outer member 50 and inner member 50*b* and into second barrel 65. However, as shown in FIG. 3, axle 53 may have an opening into which second barrel 65** may be fitted to allow for the passage of fluid.

Figure 6:
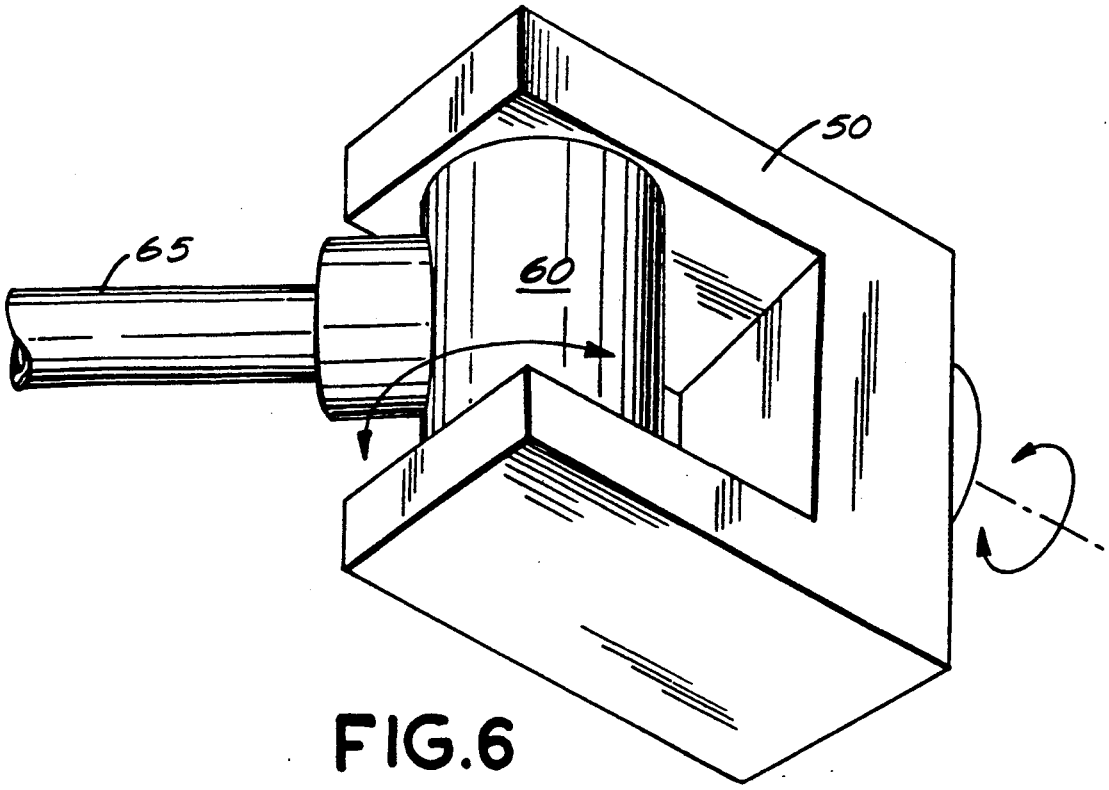
FIG. 6 is a perspective view of one embodiment of the means for orienting the nozzle assembly.

Thus it is seen that second barrel 65 can be oriented precisely to point in a particular location and the unit can be activated and pointed using one hand. Also, the orientation of nozzle assembly 8 can be changed in a tight space and can be changed continuously. Furthermore, nozzle assembly 8 can be locked in a particular orientation to handle the emission of fluid at high pressure. Pressures inside yoke 50 and member 60 can reach 150 psi. In addition, use of both yoke 50 and member 60 as different joint means having different degrees of freedom creates a strong joint mechanism for nozzle assembly 8. FIG. 6 shows the relative rotations of yoke 50 and member 60. It is not necessary that yoke 50 and member 60 be connected in the order shown. Member 60 could be positioned closer to sleeve 23 than yoke 50 and still result in a device that achieves the benefits of this invention. In addition, member 60 or yoke 50 could take the form of a ball joint.

Figure 5:
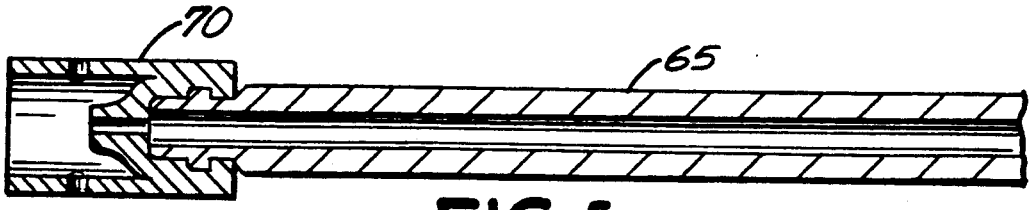
FIG. 5 is an elevational view in longitudinal section of the end of the nozzle assembly.

Referring now to FIG. 5, the end of second barrel 65 is fitted with a hood 70. One or more openings are placed in the side of hood 70 to allow fluid to escape from nozzle assembly 8 should the main opening of hood 70 become blocked or clogged. This is a safety feature to prevent accidents such as injecting fluid under the skin of the user.

What is claimed is:

1. A nozzle assembly for emitting fluid therethrough from a self-contained pressurized container comprising:

a first barrel having one end in fluid communication with a first joint means;

said first joint means being rotatable about the axis of said first barrel;

a second joint means in fluid communication with said first joint means;

said second joint means being rotatable about an axis perpendicular to the axis of rotation of said first joint means; and a second barrel in fluid communication with said second joint means, wherein the path of travel provided for said fluid within the nozzle assembly prior to entry of said fluid into said second barrel includes travel around at least a portion of said second joint means.

2. The nozzle assembly of claim 1 further comprising a means for locking the movement of said second joint means.

3. The nozzle assembly of claim 1 wherein said first joint means is rotatable about 360° about the axis of said first barrel.

4. The nozzle assembly of claim 1 wherein said second joint means is rotatable at least about 180° about the axis perpendicular to the axis of rotation of said first joint means.

5. The nozzle assembly of claim 3 wherein said second joint means is rotatable at least about 180° about the axis perpendicular to the axis of rotation of said first joint means.

6. An actuating mechanism to release fluid from a self-contained pressurized container having a dispensing spout to emit fluid therethrough upon depression comprising:

a sleeve means engageable with said spout;

a flange means engageable with a shoulder on said sleeve means to depress said sleeve means;

a lever means to transfer force applied to said lever means to said flange means causing said flange means to depress said sleeve means;

said lever means operably connected to said flange means and having a fulcrum located at a point above the top of said sleeve means;

a first barrel having one end in fluid communication with a first joint means and the other end of said first barrel in fluid communication with said spout;

said first joint means being rotatable about the axis of said first barrel;

a second joint means in fluid communication with said first joint means;

said second joint means being rotatable about an axis perpendicular to the axis of rotation of said first joint means; and a second barrel in fluid communication with said second joint means, wherein the path of travel provided for said fluid immediately prior to entry of said fluid into said second barrel includes travel around at least a portion of said second joint means.

7. The actuating mechanism of claim 6 further comprising a cap means having a shoulder means and lip means engageable with the rim of said pressurized container and operably connected to said actuating mechanism to align said actuating mechanism on said pressurized container.

8. A nozzle assembly for emitting fluid therethrough from a self-contained pressurized container comprising:

a barrel having one end in fluid communication with a first joint means;

said first joint means being rotatable about the axis of said barrel;

a second joint means in fluid communication with said first joint means; and said second joint means being rotatable about an axis perpendicular to the axis of rotation of said first joint means, wherein the path of travel provided for said fluid within the nozzle assembly includes travel around at least a portion of said second joint means.

9. The nozzle assembly of claim 8 wherein said first joint means is rotatable about 360° about the axis of said barrel.

10. The nozzle assembly of claim 8 wherein said second joint means is rotatable at least about 180° about the axis perpendicular to the axis of rotation of said first joint means.

11. The nozzle assembly of claim 9 wherein said second joint means is rotatable at least about 180° about the axis perpendicular to the axis of rotation of said first joint means.

12. An actuating mechanism to release fluid from a self-contained pressurized container having a dispensing spout to emit fluid therethrough upon depression comprising:

a lever means having a trigger means at one end, a body and a flange means at another end operably engaging said dispensing spout;

said lever means being hingedly rotatable at a point above and behind the point where said flange means operably engages said dispensing spout;

and said flange means extending in front of said point of hinged rotation and away from said body of said lever means;

a barrel having one end in fluid communication with a first joint means and having another end in fluid communication with said dispensing spout;

said first joint means being rotatable about the axis of said barrel;

a second joint means in fluid communication with said first joint means; and said second joint means being rotatable about an axis perpendicular to the axis of rotation of said first joint means, wherein the path of travel provided for said fluid includes travel around at least a portion of said second joint means.

13. The actuating mechanism of claim 12 wherein said first joint means is rotatable about 360° about the axis of said barrel.

14. The actuating mechanism of claim 13 wherein said second joint means is rotatable at least about 180° about the axis perpendicular to the axis of rotation of said first joint means.

* * * * *